US010138584B2

(12) United States Patent
Heo et al.

(10) Patent No.: US 10,138,584 B2
(45) Date of Patent: Nov. 27, 2018

(54) WASHING MACHINE AND METHOD FOR CONTROLLING THE SAME

(71) Applicant: LG ELECTRONICS INC., Seoul (KR)

(72) Inventors: Kwangchul Heo, Seoul (KR); Seungwook Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 14/642,921

(22) Filed: Mar. 10, 2015

(65) Prior Publication Data

US 2015/0252509 A1 Sep. 10, 2015

(30) Foreign Application Priority Data

Mar. 10, 2014 (KR) ..... 10-2014-0027886

(51) Int. Cl.
*D06F 37/20* (2006.01)
*D06F 35/00* (2006.01)
(Continued)

(52) U.S. Cl.
CPC ..... *D06F 37/203* (2013.01); *D06F 35/007* (2013.01); *D06F 37/24* (2013.01);
(Continued)

(58) Field of Classification Search
CPC ..... D06F 23/04; D06F 37/12; D06F 37/203; D06F 37/24; D06F 33/02; D06F 35/007;
(Continued)

(56) References Cited

U.S. PATENT DOCUMENTS 4,411,664 A 10/1983 Rickard et al.
5,301,522 A 4/1994 Ikemizu et al.
(Continued)

FOREIGN PATENT DOCUMENTS

CN 1888216 1/2007
CN 101838914 9/2010
(Continued)

OTHER PUBLICATIONS

Office Action issued in Chinese Application No. 201510104918.5 dated Sep. 5, 2016, 19 pages (with English translation).
(Continued)

*Primary Examiner* — Joseph L. Perrin
(74) *Attorney, Agent, or Firm* — Fish & Richardson P.C.

(57) ABSTRACT

A method for controlling a washing machine is described. The method includes washing laundry by rotating the pulsator in alternating directions with at least a portion of the laundry soaked in wash water in the washing tub. The method further includes draining the wash water from the washing tub; supplying additional wash water into the washing tub. The method further includes increasing a rotation speed of the washing tub with the laundry soaked in the additional wash water. The method further includes sensing a degree of vibration while increasing the rotation speed of the washing tub. The method further includes, based on the sensed degree of vibration being smaller than an allowable degree of vibration, dehydrating the laundry by draining the additional wash water from the washing tub and rotating the washing tub at an increased rotation speed.

3 Claims, 9 Drawing Sheets

(51) Int. Cl.

| | |
|---|---|
| ***D06F 33/02*** | (2006.01) |
| ***D06F 37/24*** | (2006.01) |
| *D06F 37/12* | (2006.01) |
| *D06F 23/04* | (2006.01) |

(52) U.S. Cl.
CPC ..... *D06F 23/04* (2013.01); *D06F 33/02* (2013.01); *D06F 37/12* (2013.01); *D06F 2202/065* (2013.01); *D06F 2204/065* (2013.01); *D06F 2204/084* (2013.01); *D06F 2222/00* (2013.01)

(58) Field of Classification Search
CPC ..... D06F 2222/00; D06F 2204/065; D06F 2204/085; D06F 2202/065; D06F 2232/08
See application file for complete search history.

(56) References Cited

U.S. PATENT DOCUMENTS

| | | | | |
|---|---|---|---|---|
| 6,023,854 | A * | 2/2000 | Tsunomoto | D06F 37/203 34/531 |
| 7,376,998 | B2 * | 5/2008 | Seo | D06F 35/007 68/12.06 |
| RE40,732 | E * | 6/2009 | Jeon | D06F 35/007 68/140 |
| 7,596,824 | B2 * | 10/2009 | Lee | D06F 35/007 8/159 |
| 7,797,778 | B2 * | 9/2010 | Lee | D06F 35/007 68/12.06 |
| 2006/0016021 | A1 * | 1/2006 | Kim | D06F 35/006 8/158 |
| 2007/0039106 | A1 * | 2/2007 | Stansel | D06F 37/302 8/159 |
| 2007/0050918 | A1 * | 3/2007 | Kim | D06F 37/203 8/158 |
| 2010/0000267 | A1 * | 1/2010 | Leidig | D06F 35/007 68/23 R |
| 2010/0088829 | A1 | 4/2010 | Park et al. | |
| 2011/0016638 | A1 * | 1/2011 | Kim | D06F 35/006 8/137 |
| 2011/0061172 | A1 * | 3/2011 | Koo | D06F 37/203 8/137 |
| 2011/0179584 | A1 * | 7/2011 | Kim | D06F 37/40 8/137 |
| 2011/0247146 | A1 * | 10/2011 | Miller | D06F 35/007 8/137 |
| 2012/0024016 | A1 | 2/2012 | Dunn et al. | |
| 2013/0000053 | A1 | 1/2013 | Miller et al. | |

FOREIGN PATENT DOCUMENTS

| | | |
|---|---|---|
| JP | H06-142390 | 5/1994 |
| JP | H11-309294 | 11/1999 |
| JP | 2002-028393 | 1/2002 |
| JP | 2006-141566 | 6/2006 |
| JP | 2014-008313 | 1/2014 |

OTHER PUBLICATIONS

Office Action issued in Australian Application No. 2015201205 dated Oct. 27, 2015, 7 pages.

* cited by examiner

WASHING MACHINE AND METHOD FOR CONTROLLING THE SAME

CROSS-REFERENCE TO RELATED APPLICATION

This application claims priority under 35 U.S.C. § 119 to Korean Patent Application No. 10-2014-0027886, filed on Mar. 10, 2014 in the Korean Intellectual Property Office, whose entire disclosure is incorporated herein by reference.

FIELD

The application relates to a washing machine and a method for controlling the same.

BACKGROUND

In general, washing machines are apparatuses for treating laundry by applying physical and chemical actions to the laundry using water and a detergent. A washing machine includes a water reserve tub containing water, a washing tub rotating about a vertical axis in the water reserve tub with laundry therein, and a pulsator rotating in the washing tub and removing dirt from the laundry by a frictional force between the pulsator and the laundry. The pulsator and/or washing tub rotates to remove contaminants from the laundry, the water reserve tub is drained, and thereafter the washing tub spins at high speed to dehydrate the laundry.

An excessive vibration may occur when the washing tub is rotated with laundry which is not evenly distributed. In order to prevent this, the following sequence may be done in conventional washing machines: rotating the pulsator alternately in opposite directions at the last step of the washing cycle to untangle the laundry, draining wash water, rotating the washing tub, sensing an imbalance of the washing tub during the rotation, and if a sensed degree of imbalance is within an allowable range, rotating the washing tub at high speed thereby laundry is dehydrated.

Such way, however, cannot respond to the case where drain is done with the laundry not fully untangled and thus the sensed degree of imbalance goes off the allowable range. Because the twisted or knotted clothes would not be readily redistributed or untangled without wash water in the washing tub despite the spinning of the pulsator or washing tub. A main force exerted to the laundry in washing machines where the washing tub spins about the vertical axis is an inertial force in the direction of gravity, and this force acts in a direction independent from the rotation of the washing tub or pulsator, rendering it difficult for the laundry to change its state without a water flow.

Accordingly, redistributing and imbalance sensing are performed repeatedly until the degree of imbalance reaches an allowable range, which delays entry into the dehydration cycle. In some cases, the degree of imbalance fails to come in the allowable range even with repetitive redistributing, leaving the cycle to stay before dehydration while coming up with an error. Therefore, the user needs to remove the cause of the imbalance on his own.

SUMMARY

An innovative aspect of the subject matter described in this specification may be implemented in a method for controlling a washing machine, the washing machine including a water reserve tub, a washing tub configured to rotate about a vertical axis in the water reserve tub, and a pulsator located at a lower portion of the washing tub and configured to rotate, the method including washing laundry by rotating the pulsator in alternating directions with at least a portion of the laundry soaked in wash water in the washing tub; draining the wash water from the washing tub; supplying additional wash water into the washing tub; increasing a rotation speed of the washing tub with the laundry soaked in the additional wash water; sensing a degree of vibration while increasing the rotation speed of the washing tub; and based on the sensed degree of vibration being smaller than an allowable degree of vibration, dehydrating the laundry by draining the additional wash water from the washing tub and rotating the washing tub at an increased rotation speed.

These and other implementations can each optionally include one or more of the following features. The actions further include based on the sensed degree of vibration being larger than the allowable degree of vibration, redistributing the laundry by rotating at least one of the pulsator and the washing tub with the laundry soaked in the additional wash water; after redistributing the laundry by rotating at least one of the pulsator and the washing tub, increasing the rotation speed of the washing tub with the laundry soaked in the additional wash water and sensing a second degree of vibration; and based on the second degree of vibration being smaller than the allowable degree of vibration, dehydrating the laundry. The action of sensing a degree of vibration while increasing the rotation speed of the washing tub includes sensing a degree of imbalance while increasing the rotation speed of the washing tub. The action of sensing the degree of imbalance includes sensing the degree of imbalance based on a variation of the rotation speed of the washing tub. A a level of wash water between the water reserve tub and the washing tub is lower than an upper end of the washing tub while increasing the rotation speed of the washing tub.

Another innovative aspect of the subject matter described in this specification may be implemented in a method for controlling a washing machine, the washing machine including a water reserve tub, a washing tub configured to rotate about a vertical axis in the water reserve tub, and a pulsator located at a lower portion of the washing tub and configured to rotate, the method including rotating the washing tub with at least a part of laundry soaked in wash water in the washing tub, the rotating including increasing a rotation speed of the washing tub until the rotation speed reaches a predetermined target rotation speed; sensing a first degree of imbalance while increasing the rotation speed of the washing tub; decreasing the rotation speed of the washing tub; and based on determining that the first degree of imbalance is smaller than an allowable degree of imbalance, dehydrating the laundry by draining the wash water from the washing tub and rotating the washing tub at an increased rotation speed.

These and other implementations can each optionally include one or more of the following features. The action of rotating the washing tub further includes based on the first degree of imbalance being larger than the allowable degree of imbalance, redistributing the laundry by rotating at least one of the pulsator and the washing tub with the laundry soaked in the wash water; further increasing the rotation speed of the washing tub and sensing a second degree of imbalance; and based on the second degree of imbalance being smaller than the allowable degree of imbalance, dehydrating the laundry by draining the wash water from the washing tub and rotating the washing tub at the increased rotation speed. A level of wash water of the water reserve tub is higher than a level of wash water of the washing tub and both are lower than an upper side of the washing tub while increasing the rotation speed of the washing tub. The actions further include rotating the washing tub includes rotating the pulsator in alternating directions before increasing the rotation speed of the washing tub.

Another innovative aspect of the subject matter described in this specification may be implemented in a washing machine including a washing tub configured to rotate about a vertical axis; a pulsator configured to rotate and located at a lower portion of the washing tub; a motor configured to rotate at least one of the washing tub and the pulsator; a drain unit configured to drain wash water from the washing tub; and a controller configured to control the motor such that rotation speed of the washing tub is increased while at least a portion of the laundry in the washing tub is soaking in the wash water; determine a degree of imbalance while the rotation speed of the washing tub is increasing; and control the drain unit and motor based on the degree of imbalance for dehydrating the laundry.

These and other implementations can each optionally include one or more of the following features. The controller is configured to control the drain unit to drain the wash water out of the washing tub and the motor to rotate the washing tub at an increased rotation speed based on the sensed degree of imbalance being smaller than an allowable degree of imbalance. The controller configured to control the motor to rotate at least one of the washing tub and the pulsator based on the degree of imbalance being larger than the allowable degree of imbalance. The controller is configured to control the motor so that rotation speed of the washing tub is increased to a target rotation speed, the washing tub is configured to rotate at the target rotation speed for a predetermined time and thereafter decrease the rotation speed of the washing tub, and the controller is configured to determine the degree of imbalance based on a variation of rotation speed of the washing tub during a period in which the rotation speed of the washing tub is increasing. The washing machine further includes a water reserve tub having the washing tub therein, where a level of wash water between the water reserve tub and the washing tub is lower than an upper side of the washing tub while the washing tub rotates at the target rotation speed.

Another innovative aspect of the subject matter described in this specification may be implemented in a washing machine including a washing tub configured to rotate about a vertical axis; a pulsator configured to rotate and located at a lower portion of the washing tub; a motor configured to rotate at least one of the washing tub and the pulsator; a drain unit configured to drain wash water from the washing tub; a vibration sensor configured to sense a vibration while the rotation speed of washing tub is increasing with at least a part of laundry soaked in wash water in the washing tub; and a controller configured to control, in response to a degree of vibration sensed by the vibration sensor, the drain unit to drain wash water from the washing tub and the motor to rotate the washing tub at an increased rotation speed for dehydrating the laundry.

These and other implementations can each optionally include one or more of the following features. The controller is configured to control the drain unit to drain the wash water from the washing tub and the motor to rotate the washing tub at the increased rotation speed, based on the degree of vibration being smaller than an allowable degree of vibration. The controller is configured to control the motor to rotate at least one of the washing tub and the pulsator based on the degree of vibration being larger than the allowable degree of vibration. The controller is configured to control the motor such that the rotation speed of the washing tub is increased to a target rotation speed, the washing tub is configured to rotate at the rotation target speed for a predetermined time and thereafter decrease the rotation speed of the washing tub, and the vibration sensor is configured to sense the degree of vibration during a period in which the rotation speed of the washing tub is increased to the target rotation speed. The washing machine further includes a water reserve tub having the washing tub therein, where a level of wash water between the water reserve tub and the washing tub is lower than an upper side of the washing tub while the washing tub rotates at the target rotation speed.

An object of the subject matter described in this application is to provide a washing machine that determines whether to perform dehydration based on a degree of vibration (or degree of imbalance) sensed in a cycle during which the washing tub spins with wash water filled in, and a method for controlling the same.

Another object of the subject matter described in this application is to provide a washing machine that may smoothly untangle laundry even when sensing a degree of vibration out of an allowable range and a method for controlling the same.

Still another object of the subject matter described in this application is to provide a washing machine that may reduce the time for entry into dehydration while preventing entry into dehydration and a method for controlling the same.

DETAILED DESCRIPTION

Figure 1:
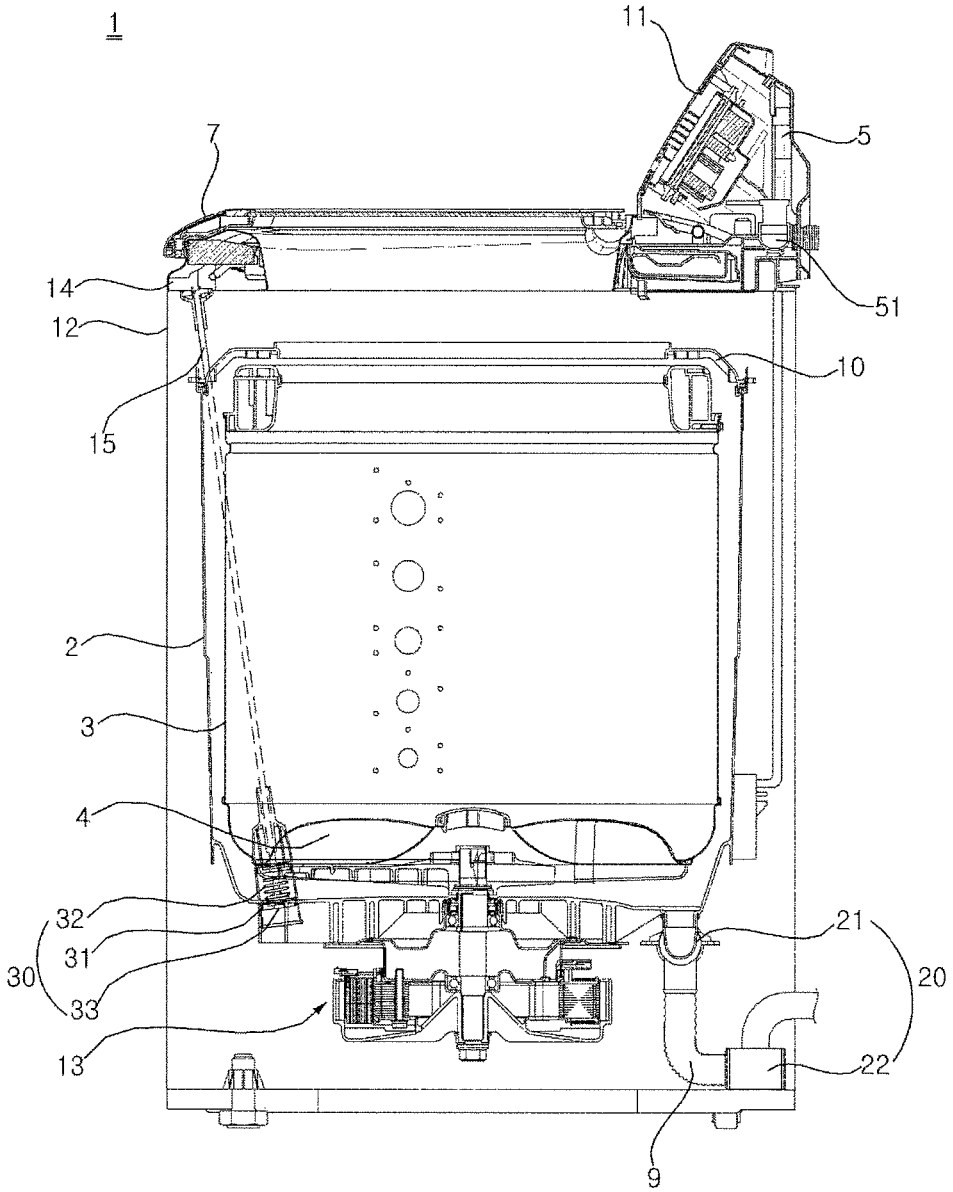
FIG. 1 is a cross-sectional view of an example washing machine.
Figure 2:
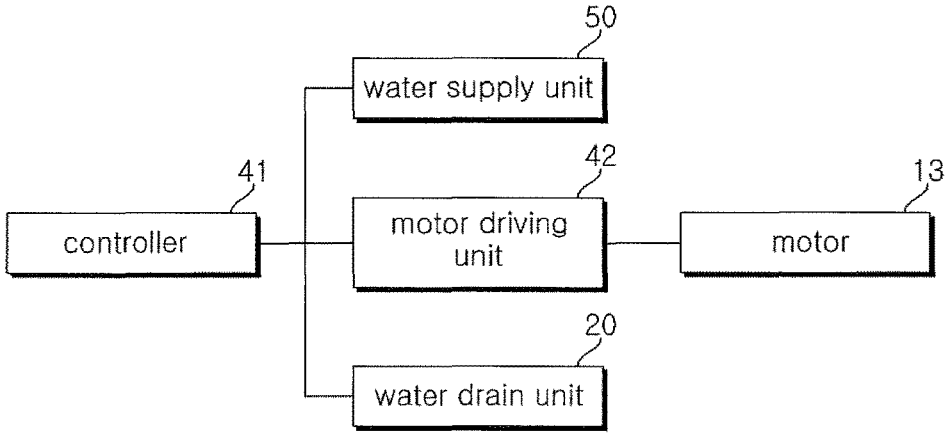
FIG. 2 is block diagram illustrating example controls for the main components of a washing machine.

FIG. 1 is a cross-sectional view of an example washing. FIG. 2 is block diagram of example controls for the main components of a washing machine.

Referring to FIGS. 1 and 2, the washing machine 1 includes a cabinet 12 with an opened top, a control panel 11 providing a user interface which has manipulation keys for entry of various control commands from a user and a display displaying information regarding the operational state of the washing machine, a top cover 14 provided at the opened top of the cabinet 12 and having an entrance hole substantially at the center thereof for putting in laundry, and a door 7 rotatably provided at the top cover 14 to open and close the entrance hole.

A water reserve tub 2 containing wash water is hung inside the cabinet 12 by a supporting rod 15. A washing tub 3 is rotatably provided inside the water reserve tub 2 to receive laundry. A pulsator 4 is rotatably provided on the bottom of the washing tub 3. The washing tub 3 has a plurality of pores through which wash water flows between the washing tub 3 and the water reserve tub 2.

A water reserve tub cover 10 with an opening at the center thereof may be provided at an upper end of the water reserve tub 2. In this case, while the water reserve tub 3 rotates, the water stream risen along a space between the water reserve tub 2 and the washing tub 3 may be prevented from overflowing the water reserve tub 2, and depending on water levels or rotation speed of the washing tub 3, the water stream may be guided along the water reserve tub cover 10 to the washing tub 3.

As a motor 13 rotates, at least one of the pulsator 4 and washing tub 3 may rotate. There may be further provided a clutch mechanism that selectively transfers the rotational force of the motor 13 to the pulsator 4 and/or the washing tub 3. The pulsator 4 may rotates alone or together with the washing tub 3 according to switching operation of the clutch mechanism.

An end of the supporting rod 15 is pivotally connected to the top cover 14, and the other end of the supporting rod 15 is connected to the water reserve tub 2 by a shock-absorbing device 30. The shock-absorbing device 30 couples the supporting rod 15 with the water reserve tub 2 and mitigates vibration of the water reserve tub 2 that occurs when the washing machine operates. The shock-absorbing device 30 may include a cap 31 engaged to an outer surface of the water reserve tub 2 and a spring 32 supporting the cap 31. The spring 32 is elastically deformed as the water reserve tub 2 vibrates. The supporting rod 15 penetrates the cap 31, and the other end thereof forms a support 33 supporting the spring 32. When the water reserve tub 2 vibrates, the cap 31 is moved together with the water reserve tub 2 and slid along the supporting rod 15. Shock absorbing is done by the interaction between a frictional force between the cap 31 and the support 33 as the cap 31 moves, a viscous force acting as air passes out between an inner circumferential surface of the cap 31 and the support 33, and an elastic/restorative force created as the spring 32 elastically deforms.

A water supply unit 50 supplies wash water into the water reserve tub 2 and/or the washing tub 3. The water supply unit 50 may include a water supply valve 51 for opening and closing a water supply passage 5 connected with an external water source, e.g., a faucet.

A drain unit 20 drains the wash water discharged from the water reserve tub 2 to the outside. The drain unit 20 may include a water drain valve 21 for opening and closing a water drain passage 9 connected with the water reserve tub 2 and a water drain pump 22 for pumping the wash water flowing through the water drain passage 9 to the outside of the washing machine 1. In some implementations, the water drain valve 21 and the water drain pump 22 both are provided. Alternatively, draining or stop draining water may be done with a water drain pump without a separate water drain valve.

The motor 13 may be speed controllable one. The rotation speed of the motor 13 follows a command speed ($\omega^*$) set by the controller 41. A motor driving unit 42 may include a velocity controller for controlling the current or voltage applied to the motor 13 so that the current speed ($\omega$) of the motor 13 follows the command speed ($\omega^*$), and examples of such velocity controller may include a proportional-integral controller or proportional-integral-derivative controller as widely known.

The controller 41 controls the overall operation of the washing machine 1, particularly, the water supply unit 50, the motor driving unit 42, and the drain unit 20. Unless otherwise mentioned, hereinafter, the components are controlled by the controller 41.

Figure 3:
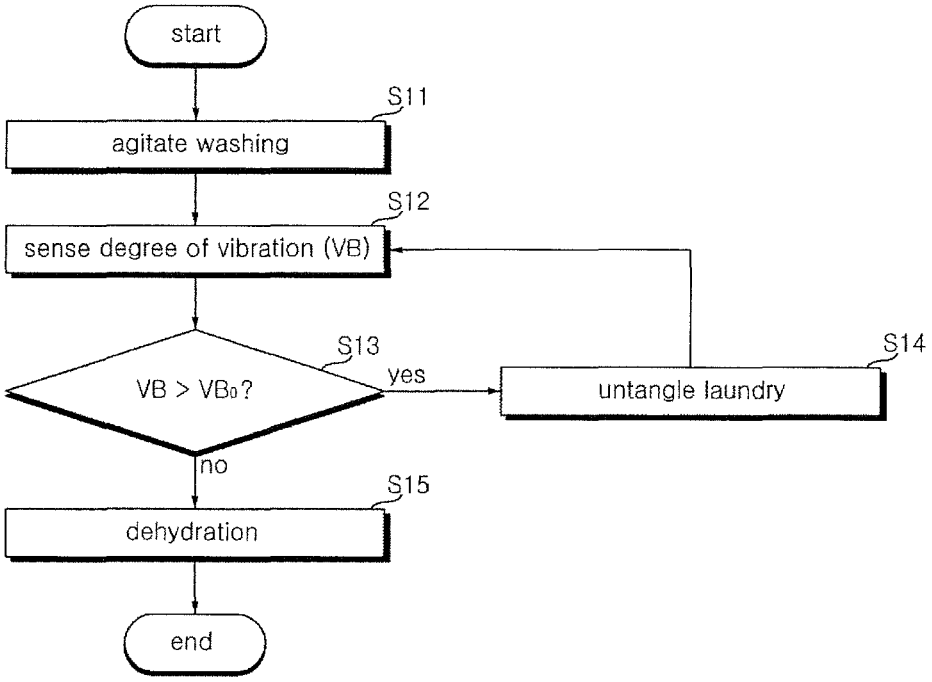
FIG. 3 is a flowchart of an example method for controlling a washing machine.

FIG. 3 is a flowchart of an example method for controlling a washing machine. Referring to FIG. 3, the washing machine 1 rotates at least one of the pulsator 4 and the washing tub 3 to remove containments from the laundry, drains the water reserve tub 2, and then rotates the washing tub 3 at high speed for dehydrating the laundry. This series of processes may, depending on whether the processes is performed with wash water contained in the washing tub 3 (i.e., with at least part of the laundry soaked in the wash water) or performed after draining washing water from the washing tub 3, be classified as a contaminant processing step or dehydrating step.

In the contaminant processing step, at least one of the pulsator 4 and the washing tub 3 rotates while the wash water is contained in the washing tub 3. In the dehydrating step, the washing tub 3 rotates at high speed after the draining wash water. According to general classification of operation in a conventional washing machine, the operation of the washing machine includes a washing cycle, a rinsing cycle, and a dehydrating cycle. The contaminant processing step is performed during the washing cycle or the rinsing cycle, and the dehydrating step is performed during the dehydrating cycle. The washing cycle and the rinsing cycle are the same in that both cycles remove contaminants from the laundry using wash water, and unless required to be specially distinguished from each other, the cycles are generally referred to as 'washing,' 'washing step,' or 'washing period,' hereinafter.

As shown in FIG. 3, an agitate washing step S11, a vibration degree sensing step S12, a dehydration vibration estimating step S13, and a laundry untangling step S14 are performed while the washing tub 3 is filled with washing water, i.e., during the washing period, and dehydration step S15 is performed during the dehydrating period. The steps are now described in greater detail.

In the agitate washing step S11, the washing tub 3 remains stationary, and the pulsator 4 rotates alternately in opposite directions (hereinafter, referred to as "agitating rotation"). In the agitate washing step S11, contaminants are actively removed from the laundry by a strong physical force exerted from the pulsator 4 to the laundry. In the step S11, when the pulsator 4 changes its rotation direction from forward to backward, the laundry may be tangled and laundry imbalance occurs due to the rotational inertia that renders the laundry to keeping on rotating in the forward direction.

In the vibration degree sensing step S12, vibration caused by the laundry imbalance is sensed. The vibration may be a value reflecting the displacement of the water reserve tub 2, the washing tub 3, or the washing machine 1 itself that is sensed while the washing tub 3 rotates.

Figure 5:
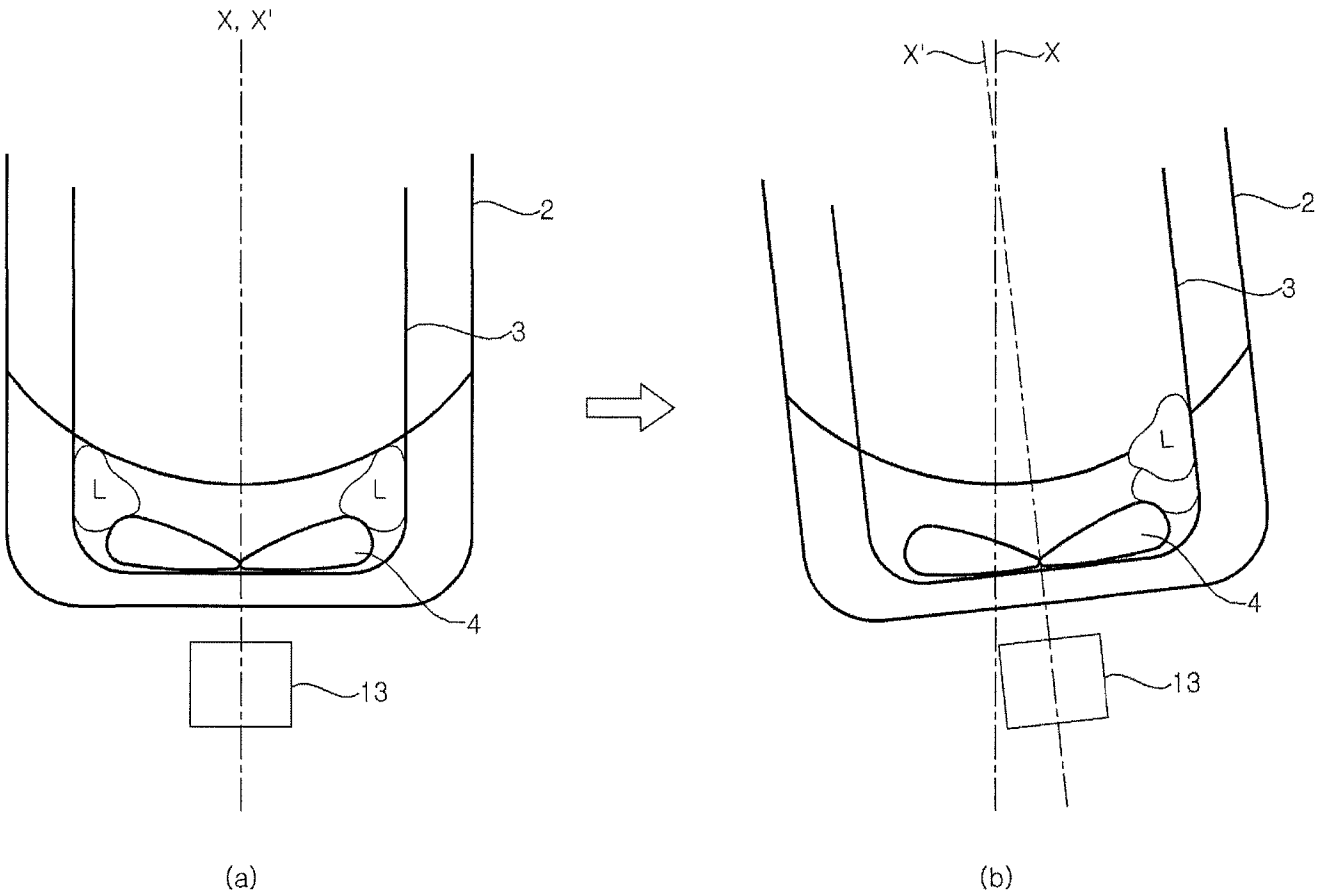
FIG. 5 illustrates horizontal vibration of an example washing machine.

In the type of washing machine 1 where the washing tub 3 rotates about a vertical axis, vertical vibration may be shock-absorbed in part by the shock-absorbing device 30. So horizontal vibration should be managed more delicately. Referring to FIG. 5, in case (a) where the washing tub 3 rotated with the laundry L evenly distributed in the washing tub 3, a geometrical axis (X) of the washing tub 3 when the washing tub 3 remains stationary is consistent with an actual rotational axis (X') of the washing tub 3. However, in case (b) where the washing tub 3 rotates in unbalanced state, the washing tub 3 is rotated about actual rotational axis (X') inclined with respect to the geometrical axis (X). As such, it is the major cause of a horizontal vibration that the laundry imbalance occurs and resultantly the washing tub 3 rotates about actual rotational axis (X') inclined with respect to the geometrical axis (X).

Recent trend goes for minimizing the overall volume of washing machine while increasing, as possible, the size of the washing tub 3 which is directly related to the capacity of treating laundry. So the gap between the washing tub 3 and the water reserve tub 2 or between the water reserve tub 2 and the cabinet 12 tends to be gradually reduced. Accordingly, if it is fails to manage the horizontal vibration to be lower than a predetermined level, the components, that is, reserve tub 2, washing tub 3 and/or cabinet may be crashed into each other.

It is important to predict or estimate a degree of vibration that is to be caused during the dehydrating process before dehydration because even if a vibration occurs over an allowable range and is sensed during dehydration, it would be difficult to redistribute the laundry plastered on an inner surface of the washing tub 3 which has been drained. In some implementations, a vibration is sensed during the washing period while the laundry (at least partially) soaked in the wash water (vibration degree sensing step S12), and dehydration is performed depending on degrees of vibration sensed in step S12. Accordingly, when the degree of vibration sensed in step S12 exceeds the allowable range, the laundry untangling step S14 is performed while at least part of the laundry soaked in the wash water, before draining the wash water for hydrating, thus inducing change of state on the laundry and removing imbalance.

Since in the vibration degree sensing step S12 the sensed degree of vibration (VB) is a reference for determining whether to perform dehydration, it only makes sense that the sensed degree of vibration (VB) has a correlation with a degree of vibration caused during dehydration.

Figure 9:
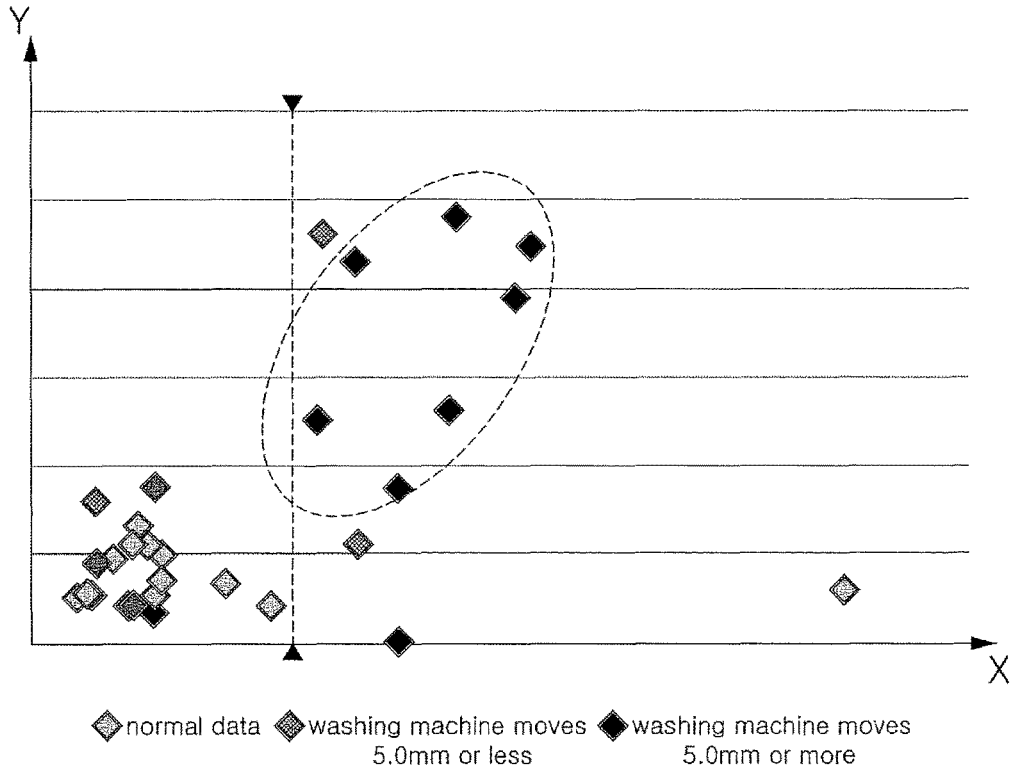
FIG. 9 is a graph of a correlation between a degree of vibration measured in an accelerating cycle and a degree of vibration measured in a dehydration cycle.

As shown in FIG. 9, the degree of vibration measured while accelerating the rotation of the washing tub 3 with at least part of the laundry soaked in the wash water (this degree of vibration is hereinafter referred to a "degree of vibration measured in an acceleration period") has a high correlation with the degree of vibration sensed while performing dehydration at a predetermined speed (this degree of vibration is hereinafter referred to as a "degree of vibration measured during dehydration"). In particular, the dots circled by dashed-lines as shown in FIG. 9 denote the cases where the displacement of washing machine 1 has been measured 5 mm or more, and it can be seen that as the degree of vibration measured in the acceleration period increases along the X axis, the degree of vibration measured during dehydration also increases along the Y axis.

Meanwhile, the following two aspects of water flow may be considered as induced when the rotation of washing tub 3 is accelerated in the vibration degree sensing step S12.

First, it is the case where the water level S elevated by a centrifugal force along a space between the washing tub 3 and the water reserve tub 2 does not go over an upper end of the washing tub 3. In some implementations, the water level S remains below the upper end of the washing tub 3 during the period in which the rotation of washing tub 3 is accelerated to the target speed, and also while the washing tub 3 rotates at a predetermined target speed.

Second, it is the case where the water level S elevated by a centrifugal force along a space between the washing tub 3 and the water reserve tub 2 and overflows the end of the washing tub 3 and is poured into the washing tub 3 along the water reserve tub cover 10 (refer to FIG. 1).

In the vibration degree sensing step S12, the washing tub 3 rotates in either of the above two cases. In some implementations, the second case may cause the laundry to be twisted or tangled, or lint gathered on the bottom of the water reserve tub 2 may be introduced back to the inside of the washing tub 3.

If the degree of vibration VB sensed in the vibration degree sensing step S12 is smaller than an allowable degree of vibration VBO, the dehydrating step S15 may be performed in which the washing tub 3 rotates at high speed to dehydrate the laundry. In contrast, in case the degree of vibration VB sensed is larger than the allowable degree of vibration VBO, the laundry untangling step S14 is performed to redistribute the laundry in the washing tub 3, and the vibration degree sensing step S12 may then repeat. In the laundry untangling step S14, at least one of the pulsator 4 and the washing tub 3 rotates in a agitating manner (e.g. alternative rotation in clockwise and counter clockwise).

Meanwhile, the washing machine 1 may include a vibration sensing means, separately from the motor 13, to sense vibration. The vibration sensing means may be configured as a capacitive displacement sensor for estimating a degree of vibration depending on variations in capacitance induced between two pole plates respectively installed at a fixture (e.g., the cabinet 12) and a vibrational body (e.g., the water reserve tub 2).

However, a degree of imbalance sensed while the washing tub 3 rotates may be as an indication reflecting a degree of vibration. Thus, rather than providing a separate displacement sensor, a degree of imbalance may be sensed in the vibration degree sensing step S12, the sensed degree of imbalance may be compared with an allowable degree of imbalance in the dehydration vibration estimating step S13, and based on the comparison, the laundry untangling step S14 or the dehydrating step S15 may be performed.

Figure 6:
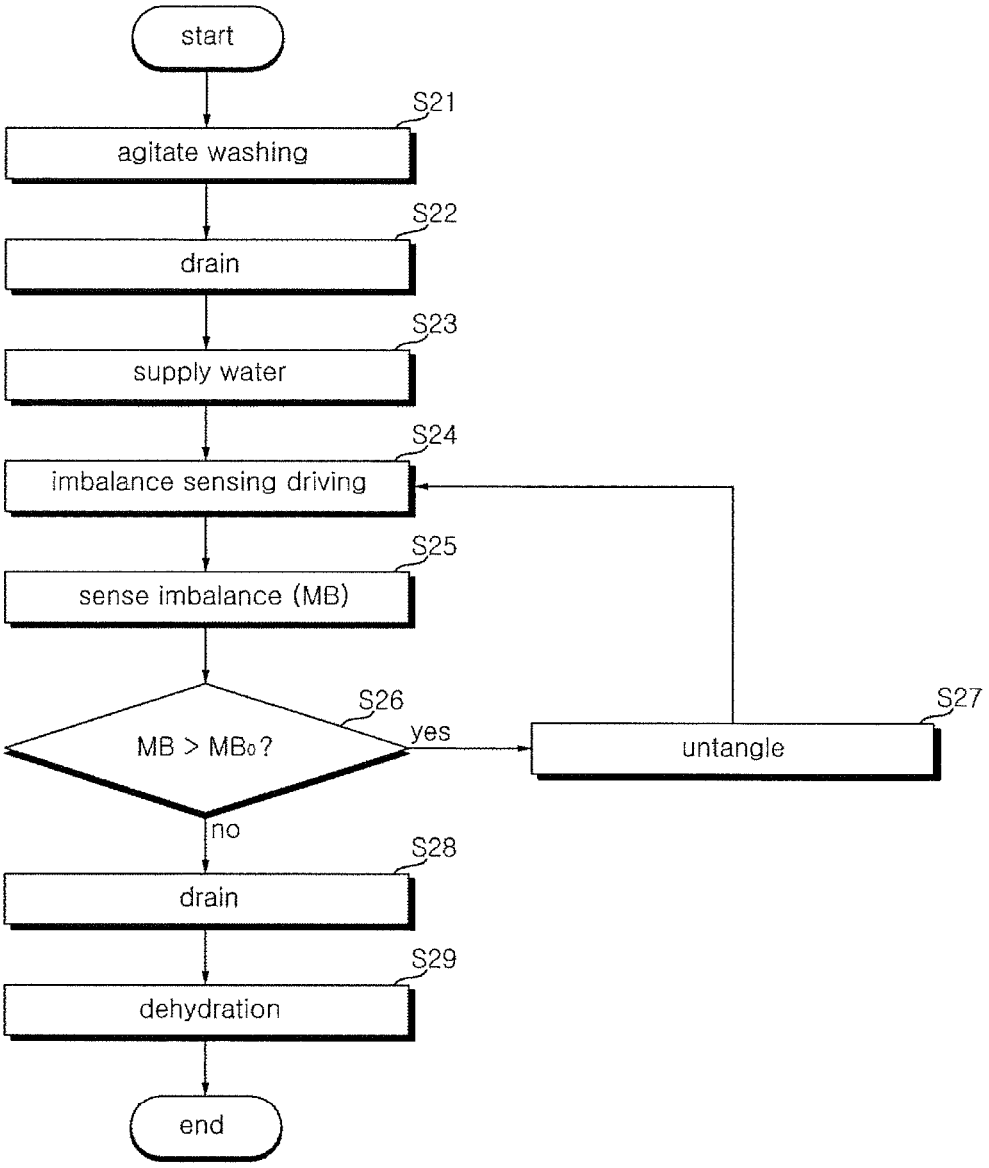
FIG. 6 is a flowchart of an example method for controlling a washing machine.

FIG. 6 is a flowchart of an example method for controlling a washing machine.

An agitate washing step S21 is performed during the washing period. In the agitate washing step S21, the pulsator 4 is rotated in an agitating manner (alternative rotation in clockwise and counter clockwise) with the washing tub 3 remaining stationary, and the laundry is subjected to washing.

Figure 4:
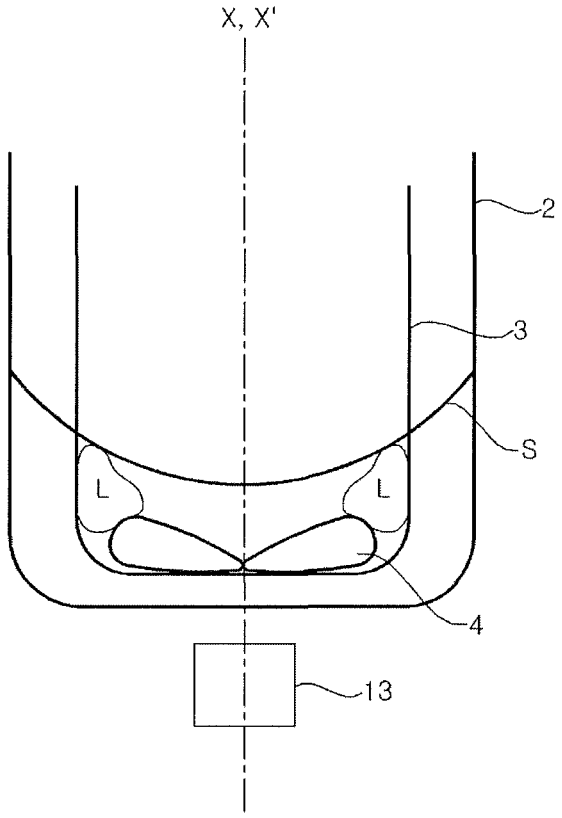
FIG. 4 is a view of the water level in an example washing tub during a cycle when a degree of vibration is sensed.

In a draining step S22, the wash water is drained from the water reserve tub 2 by the drain unit 20, and wash water supplied to the washing tub 3 (S23). In a water supply step S23, wash water is fed to the inside of the washing tub 3 up to a preset water level by the supply unit 50. In some implementations, the preset water level is set in a range that even when the washing tub 3 rotates at a predetermined speed in an imbalance sensing driving step S24 to be described below, the wash water elevated between the washing tub 3 and the water reserve tub 2 by a centrifugal force does not overflow the upper end of the washing tub 3 (refer to FIG. 4).

Imbalance sensing driving step S24 including accelerating rotation of the washing tub 3 to a target speed, rotating the washing tub 3 at the target speed, and decelerating (or braking) the washing tub.

During the imbalance sensing driving step S24, a degree of imbalance MB is sensed (imbalance sensing step S25). The degree of imbalance may be obtained based on a variation in rotation speed of the washing tub 3. Among the acceleration period in which the rotation speed of the washing tub 3 is accelerated to the target speed, the maintaining period in which the washing tub 3 rotates at the target speed and the decelerating period in which the washing tub 3 decelerates and brakes, the acceleration period may be for sensing the degree of imbalance.

Figure 8:
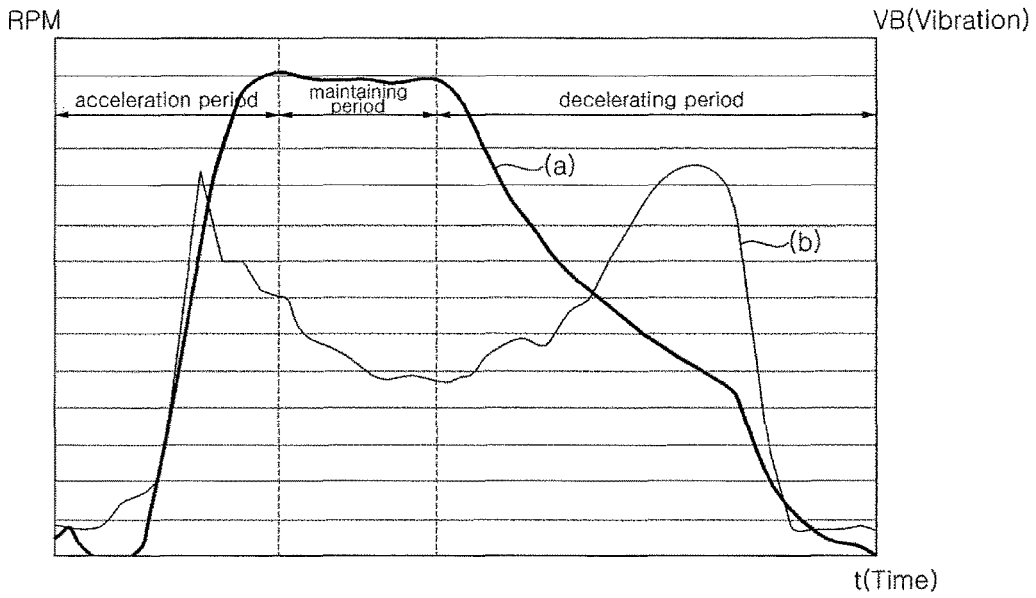
FIG. 8 is a graph of (a) spin speed (RPM axis) over time and (b) a degree of vibration (VB axis) in imbalance sensing.

FIG. 8 is a graph of (a) spin speed (RPM axis) over time and (b) a degree of vibration (VB axis) in imbalance sensing. It can be seen from the graph that among the periods, the acceleration period shows a noticeable vibration and that the degree of vibration tends to increase as the rotation speed of the washing tub 3 increases.

Meanwhile, the variation in rotation speed of the washing tub 3 corresponds to a variation in output of the motor 13, and thus, a degree of imbalance may be determined based on a variation in current output from the motor 13.

In a dehydration vibration estimating step S26, the degree of imbalance (MB) sensed in the imbalance sensing step S25 is compared with an allowable degree of imbalance ($MB_0$) to determine whether to perform drain S28 or untangling S27. The controller 41 controls the drain unit 20 to perform a draining step S28 for draining the wash water and a dehydrating step S29 for dehydrating the laundry by rotating the washing tub 3 at high speed, when the sensed degree of imbalance MB is smaller than the allowable degree of imbalance $MB_0$. Otherwise the controller 41 performs an untangling step S27 for redistributing the laundry and then repeating the imbalance sensing driving step S24, when the sensed degree of imbalance MB is larger than the allowable degree of imbalance MB0.

Figure 7:
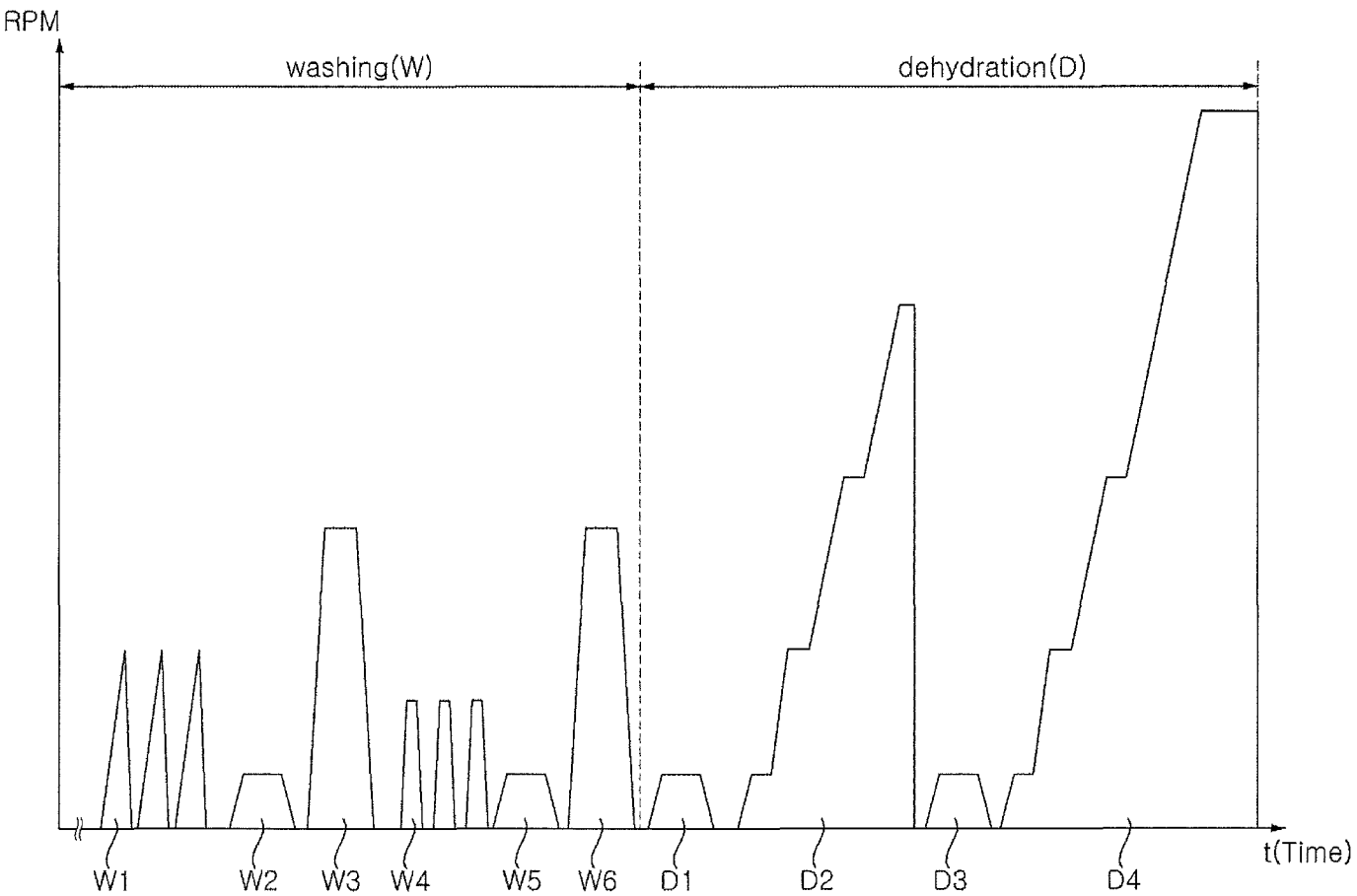
FIG. 7 is a graph of motor spin speed over time during a washing machine cycle.

FIG. 7 is a graph of motor spin speed over time during a washing machine cycle.

In a washing period W, agitate washing W1 is performed. Similar to steps S11 and S21 of the above-described implementations, the pulsator 4 is rotated in an agitating manner to remove contaminants from the laundry.

Balancing driving W2 is performed. The balancing driving W2 refers to rotating the washing tub 3 at a relatively low speed in a direction to thereby enhance the balancing of the laundry in the washing tub 3.

Imbalance sensing driving W3 rotates the washing tub 3, controlling the washing tub 3 in such a range that the wash water elevated along a space between the washing tub 3 and the water reserve tub 2 does not overflow the upper end of the washing tub 3. Degree of imbalance is sensed during a period in which rotation of the washing tub 3 is accelerated (refer to S24 and S25).

When a degree of imbalance MB sensed during imbalance sensing driving W3 is smaller than an allowable degree of imbalance $MB_0$, dehydration D is immediately initiated. When the sensed degree of imbalance MB is larger than the allowable degree of imbalance $MB_0$, laundry untangling W4 may be performed to redistribute the laundry. In laundry untangling W4, at least one of the pulsator 4 and the washing tub 3 is rotated in a agitating manner thereby the position of laundry in the washing tub 3 is changed.

After laundry untangling W4, balancing W5 and imbalance sensing driving W6 are performed. During the imbalance sensing driving W6, a degree of imbalance is sensed again. In some implementations, the balancing W4 may be omitted, and the imbalance sensing driving W6 may be performed following laundry untangle W4.

When the degree of imbalance MB sensed during the imbalance sensing driving W6 performed again is smaller than the allowable degree of imbalance MB0, dehydration D is performed. In contrast, when the degree of imbalance MB sensed during the imbalance sensing driving W6 performed again is larger than the allowable degree of imbalance MB0, balancing W5 may be performed again.

In the dehydration period D, the wash water is drained from the water reserve tub 2, and then balancing D1 and dehydration D2 may be performed. In some implementations, the balancing D1 may be omitted and dehydration D2 may be performed after the washing tub 3 is drained.

In Dehydration D2, rotation speed of the washing tub 3 is increased by stages to a target dehydration speed. After dehydration D2, balancing D3 may be performed again and dehydration D4 may be further performed in which the washing tub 3 rotates at a speed higher than the previous target dehydration speed.

In some implementations, the washing machine and method for controlling the same may reduce the time for entry into dehydration while decreasing the frequency of failure to enter the dehydration.

Further, in some implementations, the washing machine and method for controlling the same may facilitate to redistribute the laundry even when sensing a degree of vibration out of an allowable range.

Further, in some implementations, the washing machine and method for controlling the same may perform dehydration under a better condition from a stability perspective by predicting a degree of vibration that may be created before dehydration.

What is claimed is:

1. A method for controlling a washing machine, the washing machine comprising a water reserve tub, a washing tub configured to rotate about a vertical axis in the water reserve tub, and a pulsator located at a lower portion of the washing tub and configured to rotate, the method comprising:

increasing a rotation speed of the washing tub to a predetermined target rotation speed while at least a part of laundry is submerged in wash water in the washing tub;

maintaining the rotation speed of the washing tub at the predetermined target rotation speed for a predetermined time; and decreasing the rotation speed of the washing tub from the predetermined target rotation speed, wherein:

a first degree of imbalance is sensed while the rotation speed of the washing tub increases, the rotation speed of the washing tub decreases after reaching the target rotation speed, after decreasing the rotation speed of the washing tub and based on determining that the first degree of imbalance is smaller than an allowable degree of imbalance, the laundry is dehydrated by draining the wash water from the washing tub and rotating the washing tub at an increased rotation speed, a level of wash water of the water reserve tub is higher than a level of wash water of the washing tub and both are lower than an upper end of the washing tub while the rotation speed of the washing tub increases, and based on the first degree of imbalance being larger than the allowable degree of imbalance, the laundry is redistributed by rotating at least one of the pulsator and the washing tub.

2. The method of claim 1, wherein the method comprises:

after the laundry is redistributed by rotating at least one of the pulsator and the washing tub, increasing the rotation speed of the washing tub and sensing a second degree of imbalance; and based on the second degree of imbalance being smaller than the allowable degree of imbalance, dehydrating the laundry by draining the wash water from the washing tub and rotating the washing tub at the increased rotation speed.

3. The method of claim 1, wherein rotating the washing tub comprises rotating the pulsator in alternating directions before increasing the rotation speed of the washing tub.

* * * * *